US007051908B2

(12) United States Patent
Mignano

(10) Patent No.: US 7,051,908 B2
(45) Date of Patent: May 30, 2006

(54) BACKPACK HUNTING BLIND FOR A TREE STAND

(76) Inventor: Daniel Mignano, 154-61 20th Ave., Whitestone, NY (US) 11357

( * ) Notice: Subject to any disclaimer, the term of this patent is extended or adjusted under 35 U.S.C. 154(b) by 82 days.

(21) Appl. No.: 10/764,733

(22) Filed: Jan. 26, 2004

(65) Prior Publication Data

US 2005/0161478 A1 Jul. 28, 2005

(51) Int. Cl.
*A45F 4/02* (2006.01)

(52) U.S. Cl. ..... 224/153; 224/584; 224/586; 224/577; 383/4

(58) Field of Classification Search ..... 224/153, 224/154, 156, 576, 577, 584, 586; 383/4, 383/902

See application file for complete search history.

(56) References Cited

U.S. PATENT DOCUMENTS

| | | | | | |
|---|---|---|---|---|---|
| 385,657 | A | * | 7/1888 | Blanchard | 224/154 |
| 417,301 | A | * | 12/1889 | Weldon | 224/601 |
| 3,825,298 | A | * | 7/1974 | Chipman | 297/129 |
| 3,931,918 | A | * | 1/1976 | Smith et al. | 224/154 |
| 3,933,164 | A | | 1/1976 | Ness et al. | |
| 3,971,495 | A | * | 7/1976 | Velazquez | 224/154 |
| 4,236,657 | A | | 12/1980 | Brunton | |
| 4,418,854 | A | * | 12/1983 | Genovese | 224/154 |
| 4,466,516 | A | * | 8/1984 | Sicoli et al. | 190/2 |
| 4,776,503 | A | | 10/1988 | Sink | |
| 4,984,906 | A | * | 1/1991 | Little | 383/4 |
| 5,048,975 | A | * | 9/1991 | Holbrook | 383/4 |
| 5,062,234 | A | * | 11/1991 | Green | 43/1 |
| 5,467,907 | A | * | 11/1995 | Celik | 224/103 |
| 5,533,653 | A | * | 7/1996 | Kaufman | 224/577 |
| 5,562,236 | A | | 10/1996 | Monzingo | |
| 5,618,110 | A | * | 4/1997 | Sullivan | 383/4 |
| 5,649,658 | A | * | 7/1997 | Hoffman et al. | 224/576 |
| 5,762,085 | A | * | 6/1998 | Punch | 135/93 |
| 5,862,967 | A | | 1/1999 | Johnson | |
| 5,865,355 | A | | 2/1999 | Camara | |
| 5,920,931 | A | * | 7/1999 | Zuehlke et al. | 5/419 |
| 5,971,244 | A | | 10/1999 | Jaeger | |
| 6,003,749 | A | | 12/1999 | Sabo | |
| 6,021,794 | A | | 2/2000 | Guerra | |
| 6,085,767 | A | * | 7/2000 | Maslow | 135/95 |
| 6,276,828 | B1 | * | 8/2001 | Otley et al. | 383/4 |
| 6,493,891 | B1 | * | 12/2002 | Livingston | 5/636 |
| 6,510,922 | B1 | | 1/2003 | Hodnett | |
| 6,659,319 | B1 | * | 12/2003 | Purpura | 224/576 |
| 6,698,131 | B1 | * | 3/2004 | Latschaw | 43/1 |
| 2001/0017307 | A1 | * | 8/2001 | Bentzen | 224/634 |

(Continued)

OTHER PUBLICATIONS

Stillwater Outfitters, Final Approach® X-Land'r™, www.pwpstuff.comaccessories/xlander.html, p. 1 (Visited Aug. 25, 2003).

(Continued)

*Primary Examiner*—Nathan J. Newhouse
*Assistant Examiner*—Justin M. Larson
(74) *Attorney, Agent, or Firm*—Bernard S. Hoffman

(57) ABSTRACT

A backpack hunting blind for use with a portable or fixed tree stand. The backpack has shoulder straps for carrying and one or more straps on its top portion for detachably securing the backpack to a tree stand. A hunting blind made of a flexible material is secured to the backpack and stowed therein when not deployed. The hunting blind has loop fasteners for detachably securing the blind to a tree stand. A rear portion of the backpack facing a user folds downwardly for deploying the blind. Easily accessible pockets are provided on a surface which faces a user when the rear portion of the pack is folded down.

33 Claims, 4 Drawing Sheets

U.S. PATENT DOCUMENTS

| | | | |
|---|---|---|---|
| 2003/0024559 | A1 | 2/2003 | Fields |
| 2003/0116183 | A1 | 6/2003 | Hill |

OTHER PUBLICATIONS

Final Approach® X-Land'r™ www.sportsmansguide.com, pp. 1-2 (Visited Aug. 25, 2003).

*Hunting Blinds-R-Us.com, Hayhouse Blind*, www.huntingblind-v-us.com/blinds/hayhouse.html, pp. 1-3. (Visited Aug. 25, 2003).

*Huntingblind.com, Hunter's View Trophy Den Hunting Blind*, www.huntingblind.com/store, pp. 1-2 (Visited Aug. 25, 2003).

* cited by examiner

BACKPACK HUNTING BLIND FOR A TREE STAND

BACKGROUND OF THE INVENTION

1. Field of the Invention

The invention relates to a backpack hunting blind to be used in connection with a tree stand.

2. The Prior Art

Tree stands are devices used by hunters, photographers and other persons to situate themselves in an elevated position in order to gain a better vantage point than available from the ground. A user stands or sits in the tree stand which is secured to a tree of appropriate size. Known tree stands include both portable stands which are removed from the tree to which they are secured after each use and fixed stands which remain secured to a tree for multiple uses. Fixed tree stands may include a ladder for the user to climb up to and down from the stand.

It is known to use a hunting blind in conjunction with a tree stand in order to conceal the user from the game being hunted or other wildlife. A hunting blind may include a flexible sheet of material with coloration or camouflage which blends into the surrounding environment. Conventional hunting blinds for use with tree stands typically consist of a separate and discrete device or unit. As a result many users refrain from using a blind in connection with a tree stand in order to minimize the amount of equipment which must be transported to and from the location where the tree stand is installed.

It is also known to use a backpack to carry gear, provisions, etc. to a location where a user will engage in an outdoor activity such as hunting. A person using a tree stand typically will hang their backpack on a fastener which is attached to the tree that the tree stand is secured to, for example a hook screwed into the tree.

A backpack is typically hung or stowed in a position behind the user when the user sits or stands in a tree stand. In order to access the backpack and retrieve or return the contents of the backpack, the user must either remove the backpack from the fastener it is hung from or turn his or her body to reach into the backpack. The resulting movement and/or noise is undesirable as it is likely to repel the game being hunted and/or other wildlife.

Devices relating to backpacks and/or blinds alone or in combination are disclosed in the following references: U.S. Patent Application Publication Nos. 2003/0116183 A1 and 2003/0024559 A1 and U.S. Pat. Nos. 6,510,922; 6,021,794; 6,003,749; 5,971,244; 5,865,355; 5,862,967; 5,562,236; 4,776,503; 4,236,657 and 3,933,164, the disclosure of which is hereby incorporated herein by reference.

SUMMARY OF THE INVENTION

The invention relates to a backpack hunting blind for use with a tree stand. The backpack hunting blind includes a backpack having a top portion and a rear portion, one or more straps disposed on the top portion of the backpack for detachably securing the backpack hunting blind to the tree stand in a substantially vertical position and a pair of shoulder carrying straps secured to the rear portion of the backpack. A hunting blind including a flexible material is secured to the backpack and is adapted to be stowed within the backpack when the hunting blind is not deployed. Secured to the hunting blind are a plurality of loop fasteners for detachably securing the hunting blind to the tree stand when the hunting blind is deployed. The rear portion of the backpack is adapted to be folded down to allow the hunting blind to be deployed.

One benefit of the backpack hunting blind is that a hunting blind is incorporated or integrated into a backpack wherein the backpack hunting blind unit is adapted for use with a tree stand.

Another benefit is that the integrated backpack hunting blind is suitable for use with both portable and fixed tree stands.

A further benefit is that the backpack hunting blind can be quickly and easily installed in a tree stand.

Another benefit of the backpack hunting blind is that the contents of the backpack are easily and readily accessible to a user who is concealed in a tree stand with a minimum amount of sound and movement on the part of the user.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
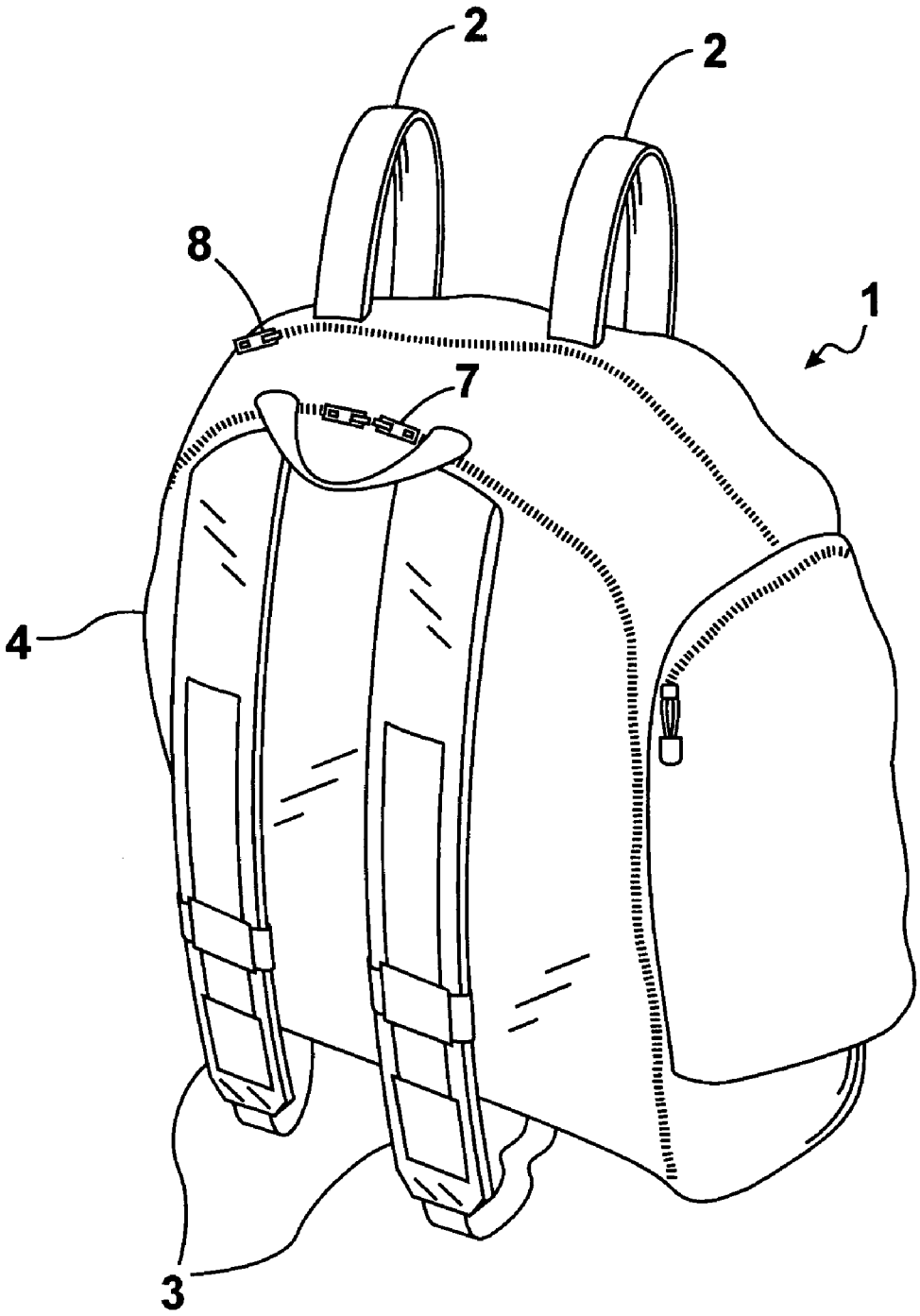
FIG. 1 shows a rear perspective view of a backpack hunting blind according to an embodiment of the invention with a rear portion in a closed position and a hunting blind in a stowed position.

FIG. 1 shows backpack hunting blind 1 with rear portion 4 in a closed position and a hunting blind (not shown) in a stowed position. One or more straps 2 are disposed at a top portion of backpack hunting blind 1. Straps 2 are configured to wrap around a front portion of a tree stand allowing backpack hunting blind 1 to detachably hang from the tree stand in a substantially vertical position. Straps 2 may be provided with any conventional detachable fastener means, for example buckles, d-rings, snaps, hook and loop fasteners, buttons or ties, for securing backpack hunting blind 1 to a tree stand.

Backpack hunting blind 1 has a pair of shoulder carrying straps 3 for transporting the unit to and from a location where it is to be used. Shoulder carrying straps 3 are disposed on a rear portion 4 of backpack hunting blind 1 and may be adjustable to accommodate users of various sizes. Rear portion 4 of backpack hunting blind 1 may be detachably secured to backpack hunting blind 1, for example with a zipper 7.

A rear portion 4 of backpack hunting blind 1 as shown in FIG. 1 is in a closed position and hunting blind portion (not shown) of backpack hunting blind 1 as shown in FIG. 1 is in a stowed position, housed within backpack hunting blind 1.

Figure 2:
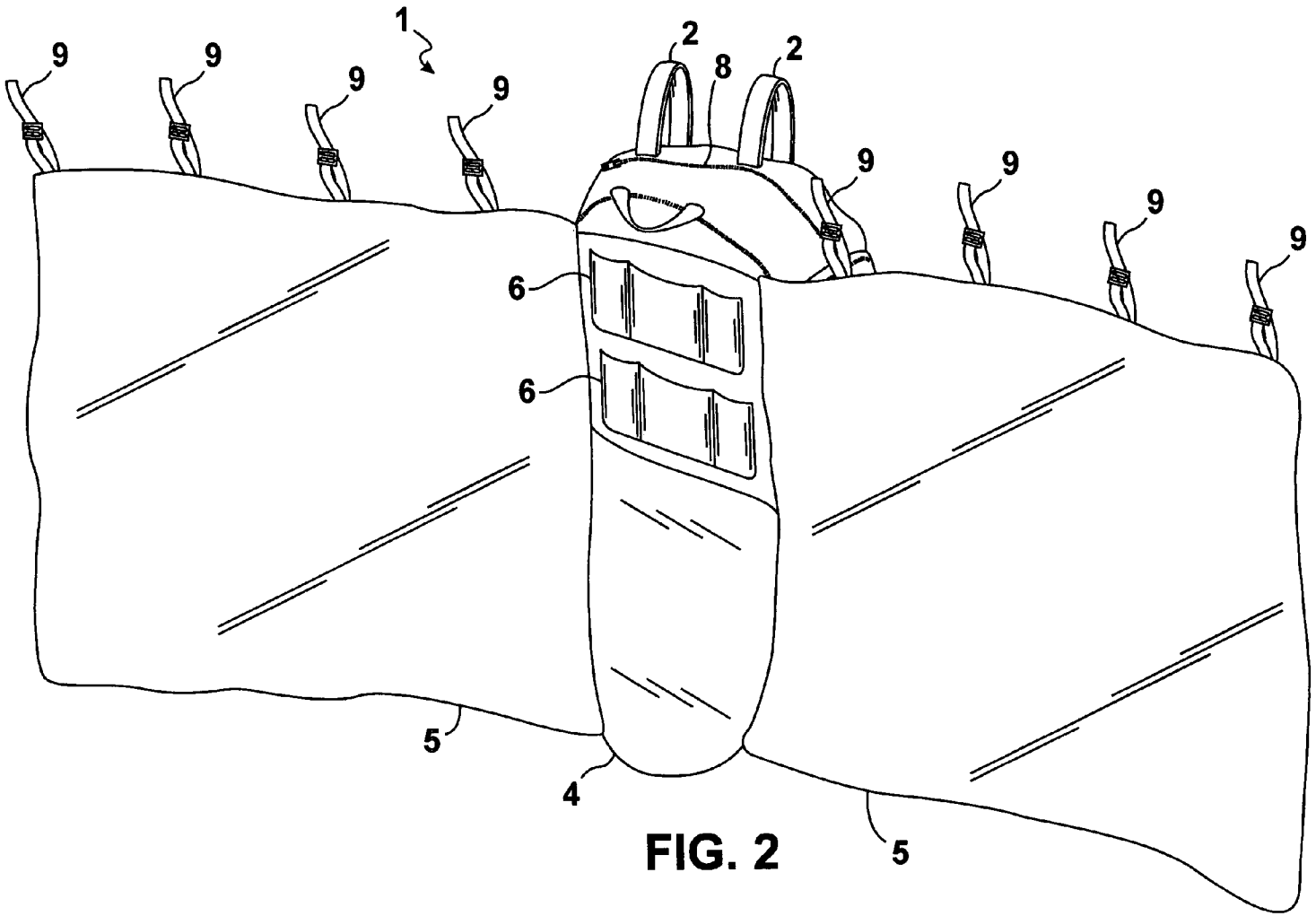
FIG. 2 shows a rear perspective view of the backpack hunting blind of FIG. 1 with a rear portion in an open position and a hunting blind in an extended position.

FIG. 2 shows backpack hunting blind 1 with rear portion 4 in an open position and hunting blind 5 in a deployed position. As shown in FIG. 2, rear portion 4 of backpack hunting blind 1 folds downward, exposing hunting blind 5 which is stowed within when not in use.

One or more pockets 6 are disposed on backpack hunting blind 1. Pockets 6 may be of various shapes and sizes, for example accordion style pockets, and are configured to store various equipment or provisions which a user of backpack hunting blind 1 may require, for example ammunition, binoculars, game calls, water bottles, communication devices, range finders, etc.

Preferably one or more pockets 6 are located on a surface of backpack hunting blind 1 which faces a user when the unit is secured in a tree stand and rear portion 4 is folded downward. In this way, pockets 6 are facing a user and are easily accessible by the user with minimal movement and or sound. A user can thus retrieve and/or return gear to pockets 6 while seated or standing in a tree stand and remain concealed from game or other wildlife. Additionally, access to a main compartment of backpack hunting blind 1 may be provided at a top portion of backpack hunting blind 1 so that a main compartment may also be easily and quietly accessed by a user who is seated or standing in a tree stand. A main compartment may be accessed, for example, via a zipper 8 provided at a top portion of backpack hunting blind 1.

Hunting blind 5 is made from a thin, flexible material which is easily wrapped or folded for storage inside backpack hunting blind. Both backpack and hunting blind 5 are preferably constructed of water repellant, weather proof materials. Backpack and hunting blind 5 may be constructed of a material which does not produce excessive noise when backpack and/or blind are opened, closed, deployed, stowed, impacted or otherwise used.

Backpack and hunting blind 5 preferably include a pattern and/or coloration on their exposed surfaces which blends into the environment where backpack hunting blind 1 is to be used. For example backpack and/or hunting blind 5 may include a camouflage pattern which conceals a user and the tree stand to which backpack hunting blind 1 is secured. Additionally, at least a portion of backpack and/or hunting blind 5 may be a highly visible color known as hunter orange.

Hunting blind 5 has a plurality of loop fasteners 9 secured at spaced-apart intervals for detachably securing hunting blind 5 to a tree stand. Loop fasteners 9 may be provided with a means for detachably securing hunting blind 5 to a tree stand, for example buckles, d-rings, snaps, hook and loop fasteners, buttons or ties.

As shown in FIG. 2, in a deployed position, hunting blind 5 extends along substantially an entire height of open pack from a top portion to a lowest portion of folded open rear portion 4. Hunting blind 5 may be detachably secured to backpack hunting blind 1 such that blind 5 may be removed from the unit when it is not needed, or for repair, replacement, exchange with a blind having a different coloration or pattern or any other purpose. For example hunting blind 5 may be detachably secured to backpack hunting blind 1 with a zipper, buckles, d-rings, snaps, hook and loop fasteners, buttons or ties.

Figure 3:
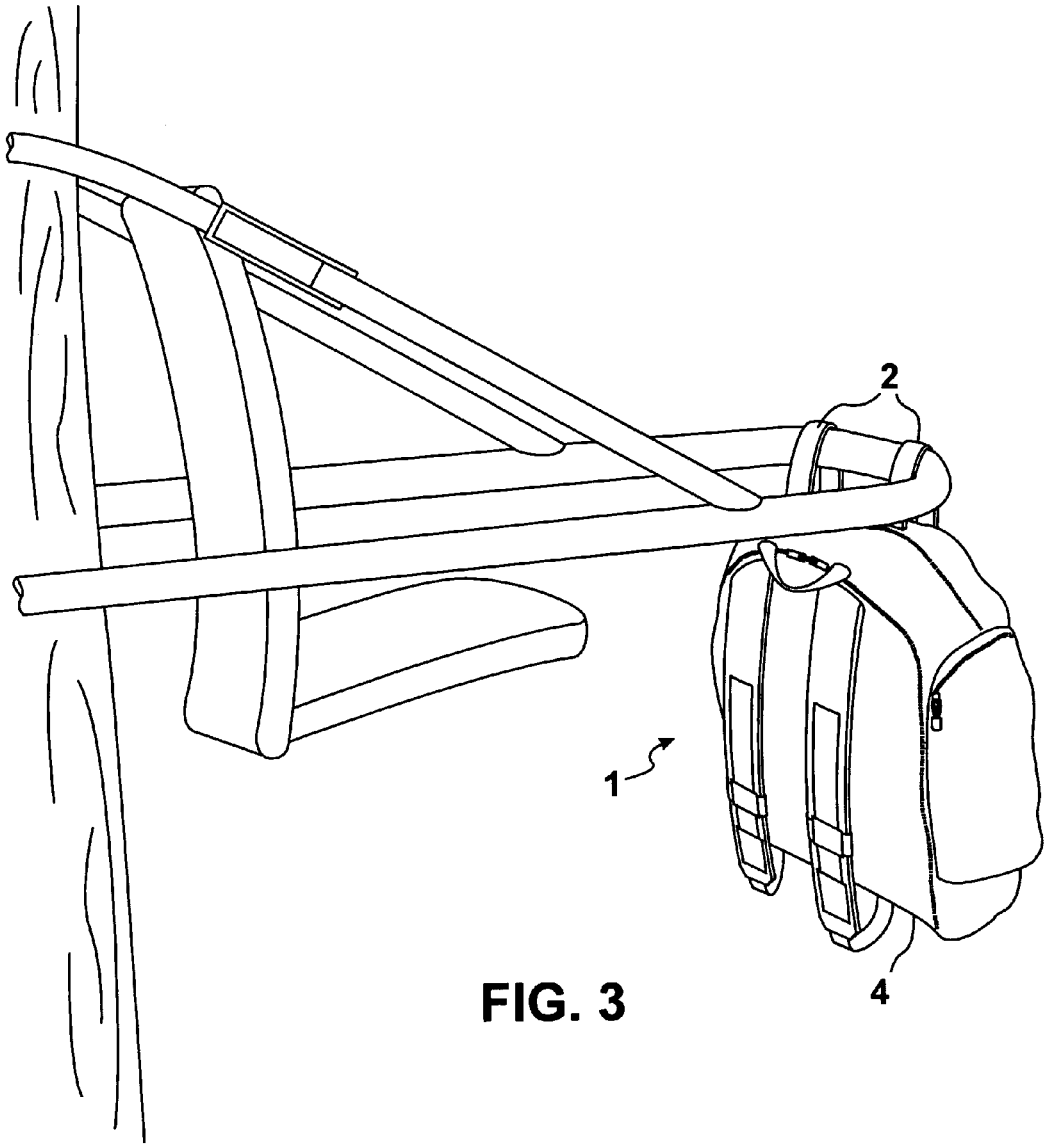
FIG. 3 shows a rear view of the backpack hunting blind of FIG. 1 wherein the backpack hunting blind is secured to a portable tree stand, a rear portion is in a closed position and a hunting blind is in a stowed position.

FIG. 3 shows a backpack hunting blind 1 detachably secured via straps 2 to a portable tree stand which in turn is secured to a tree. Rear portion 4 is in a closed position and hunting blind 5 (not shown) is in a stowed position.

Figure 4:
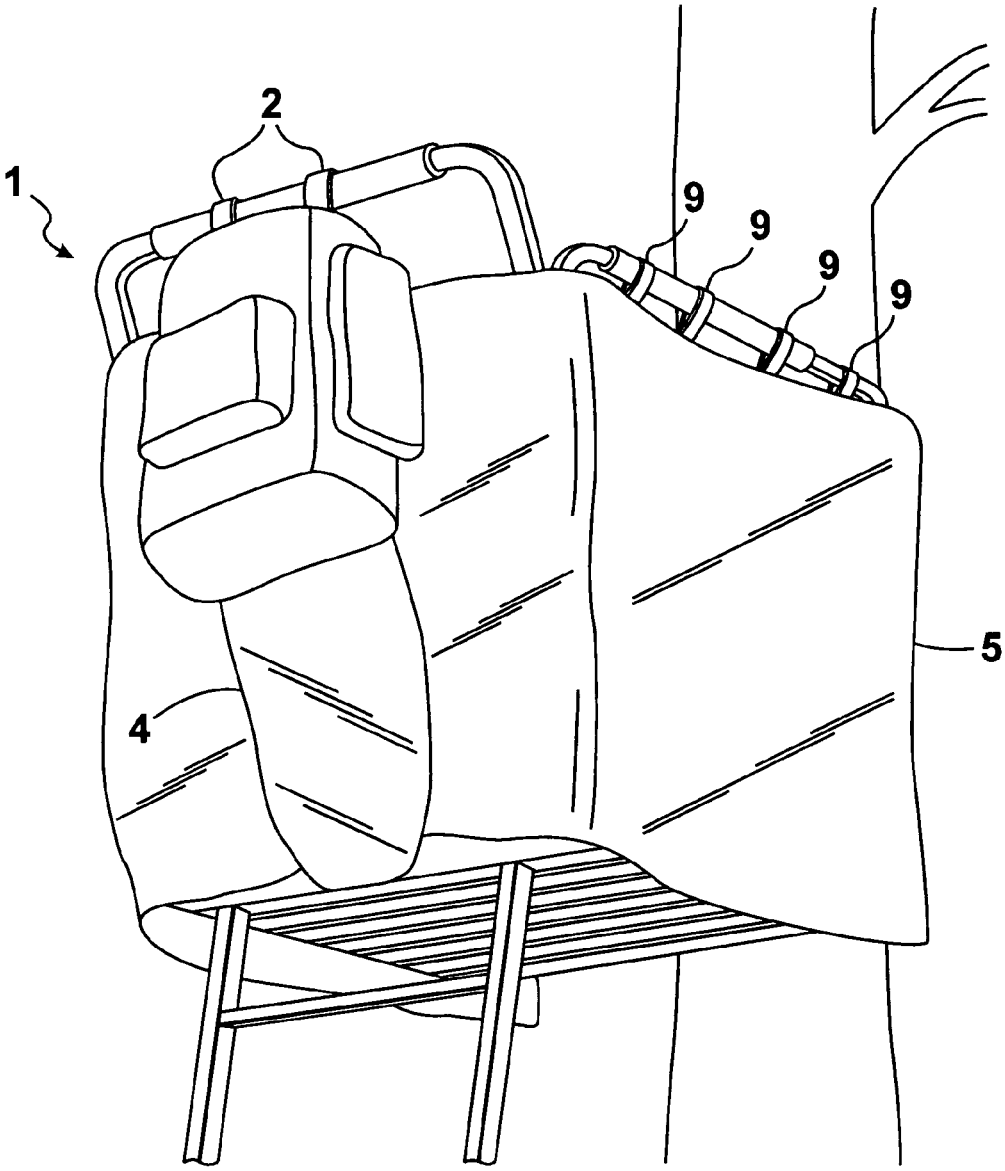
FIG. 4 shows a front perspective view of the backpack hunting blind of FIG. 1 wherein the backpack hunting blind is secured to a fixed tree stand, a rear portion is in an open position and a hunting blind is in an extended position.

Hunting blind 5 can also be used with a fixed tree stand an shown in FIG. 4. As shown in FIG. 4, in a deployed position hunting blind 5 may be draped over substantially an entire perimeter of a tree stand. When deployed hunting blind 5 effectively conceals both user and tree stand. In FIG. 4, hunting blind 5 is detachably secured to a fixed tree stand with loop fasteners 9, and backpack hunting blind 1 is detachably secured to the fixed tree stand with straps 2.

While one embodiment of the present invention has been shown and described, it is obvious that many changes and modifications may be made thereunto without departing from the spirit and scope of the invention.

What is claimed is:

1. A combination pack and hunting blind, comprising:

a.) a pack; wherein said pack has a main compartment and a secondary compartment; wherein said secondary compartment is located on an exterior surface of said main compartment, said secondary compartment having first and second surfaces, said first surface being releasably connected to said second surface along two side edges of said secondary compartment and an upper edge of said secondary compartment and pivotably connected to said second surface along a lower edge of said secondary compartment; wherein said secondary compartment has a closed position in which said first and second surfaces oppose one another inside of said secondary compartment; wherein said secondary compartment has an open position in which said first surface depends from said pack and said second surface; and b.) a hunting blind; wherein said hunting blind is secured to each of said first and second surfaces along substantially the length of said side edges of said secondary compartment; wherein said hunting blind has a stowed position and a deployed position; wherein said hunting blind is housed in said secondary compartment when said hunting blind is in said stowed position; wherein said hunting blind is deployed from said secondary compartment in said open position when said hunting blind is in said deployed position.

2. The combination as defined in claim 1, wherein said pack is a backpack.

3. The combination as defined in claim 1, wherein said pack has a rear surface; and wherein said first surface of said pack is said rear surface of said pack.

4. The combination as defined in claim 1, wherein said hunting blind is made of a thin, flexible material which is easily wrapped and folded so as to be easily stowed inside said secondary compartment when said hunting blind is in said stowed position thereof.

5. The combination as defined in claim 1, wherein said first surface of said secondary compartment is detachably secured to said second surface by a zipper.

6. The combination as defined in claim 1, wherein said hunting blind extends from both sides of said pack when said hunting blind is in said deployed position thereof.

7. The combination as defined in claim 1, wherein said hunting blind extends from both sides of said first surface of said secondary compartment when said hunting blind is in said deployed position thereof.

8. The combination as defined in claim 1, wherein said hunting blind is secured to both of said first and second surfaces along each of said side edges of said secondary compartment.

9. The combination as defined in claim 1, wherein said pack is made from a water repellant material;

wherein said pack is made from a water proof material;

wherein said hunting blind is made from a water repellant material; and wherein said hunting blind is made from a water proof material.

10. The combination as defined in claim 1, wherein said hunting blind is detachably secured to said first and second surfaces so as to allow said hunting blind to be removed from said pack when not needed or for repair, replacement, or exchange.

11. The combination as defined in claim 1, wherein said pack has at least one of a pattern and a coloration;

wherein said pack has exposed surfaces;

wherein said at least one of said pattern and said coloration of said pack is on said exposed surfaces of said pack for blending into the environment where said pack is to be used;

wherein said hunting blind has at least one of a pattern and a coloration;

wherein said hunting blind has exposed surfaces;

wherein said at least one of said pattern and said coloration of said hunting blind is on said exposed surfaces of said hunting blind for blending into the environment where said hunting blind is to be used.

12. The combination as defined in claim 11, wherein said pattern is a camouflage pattern.

13. The combination as defined in claim 1; further comprising at least one carrying strap;

wherein said at least one carrying strap is disposed on said pack; and wherein said at least one carrying strap is for use in carrying said combination pack and hunting blind.

14. The combination as defined in claim 13, wherein said pack has a fourth surface; and wherein said at least one carrying strap is disposed on said fourth surface of said pack.

15. The combination as defined in claim 14, wherein said fourth surface of said pack is said first surface of said pack; and wherein said at least one carrying strap is a pair of shoulder straps.

16. The combination as defined in claim 1; further comprising at least one pocket; and wherein said at least one pocket is disposed on said pack.

17. The combination as defined in claim 16, wherein said at least one pocket is located on said second surface of said secondary compartment which is only accessible when said secondary compartment is in said open position thereof and said hunting blind is in said deployed position thereof.

18. The combination as defined in claim 16, wherein said at least one pocket, when more than one pocket, are of various shapes and sizes.

19. The combination as defined in claim 16, wherein said at least one pocket is an accordion style pocket.

20. The combination as defined in claim 1; further comprising second means; and wherein said second means is for detachably securing said hunting blind to a tree stand in a substantially vertical position when said combination pack and hunting blind is used with a tree stand, said secondary compartment is in said open position thereof, and said hunting blind is in said deployed position thereof.

21. The combination as defined in claim 20, wherein said second means includes fourth means for detachably fastening said second means.

22. The combination as defined in claim 21, wherein said fourth means is selected from the group consisting of buckles, D-rings, snaps, hook and loop fasteners, buttons, and ties.

23. The combination as defined in claim 20, wherein said second means includes at least one loop.

24. The combination as defined in claim 23, wherein said at least one loop of said second means is at least one strap.

25. The combination as defined in claim 23, wherein said at least one loop of said second means, when more than one loop, are spaced-apart from each other.

26. The combination as defined in claim 1; further comprising first means; and wherein said first means is for detachably securing said pack to a tree stand to hang in a substantially vertical position when said combination pack and hunting blind is used with a tree stand.

27. The combination as defined in claim 26, wherein said first means includes at least one loop.

28. The combination as defined in claim 27, wherein said at least one loop of said first means is at least one strap.

29. The combination as defined in claim 26, wherein said pack has a third surface; and wherein said first means is disposed on said third surface of said pack.

30. The combination as defined in claim 29, wherein said pack has a top surface; and wherein said third surface of said pack is said top surface of said pack.

31. The combination as defined in claim 30, wherein said pack has an interior; and defined by said main compartment.

32. The combination as defined in claim 31, wherein said interior of said pack is accessible from said top surface of said pack.

33. The combination as defined in claim 32, wherein said top surface of said pack has a zipper; and wherein said interior of said pack is accessible from said zipper of said top surface of said pack.

* * * * *